United States Patent [19]

Henderson

[11] 4,239,231

[45] Dec. 16, 1980

[54] THREE-DIMENSIONAL DOMINO GAME

[76] Inventor: David G. Henderson, 506 Sanchez St., San Francisco, Calif. 94114

[21] Appl. No.: 929,081

[22] Filed: Jul. 28, 1978

[51] Int. Cl.[3] ..... A63F 9/20

[52] U.S. Cl. ..... 273/293; 46/25

[58] Field of Search ..... 273/293, 294, 295, 296; 35/31 G; 46/25

[56] References Cited

U.S. PATENT DOCUMENTS

| | | | |
|---|---|---|---|
| 2,262,199 | 11/1941 | Paulson | 46/25 |
| 3,481,603 | 12/1969 | Sugden . | |
| 3,547,444 | 12/1970 | Williams . | |
| 3,672,681 | 6/1972 | Wolf . | |
| 3,766,667 | 10/1973 | Glassman . | |
| 3,773,327 | 11/1973 | Kremer . | |
| 3,827,695 | 8/1974 | Hess . | |
| 3,845,574 | 11/1974 | Majewski | 273/293 X |
| 3,862,512 | 1/1975 | Vogel . | |
| 3,866,338 | 2/1975 | Lou . | |
| 3,871,657 | 3/1975 | Lorenz et al. . | |

OTHER PUBLICATIONS

"Jumbinoes" Advertising Brochure, one sheet.

*Primary Examiner*—Anton O. Oechsle
*Attorney, Agent, or Firm*—Townsend and Townsend

[57] ABSTRACT

A set of dominoes is disclosed which can be used for a three-dimensional domino game. The indicia on the top surface of the dominoes are in the form of raised pegs, and each domino has a socket on its under surface directly below and complementary to each raised peg on the top surface. The dominoes can be used for a three-dimensional game in which dominoes are placed next to each other on the same level or on top of each other where the sockets of the upper domino receive all of the pegs directly below it.

4 Claims, 10 Drawing Figures

THREE-DIMENSIONAL DOMINO GAME

SUMMARY OF THE INVENTION

A set of dominoes is disclosed which can be used for a three-dimensional domino game. The indicia on the top surface of the dominoes are in the form of raised pegs, and each domino has a socket on its under surface directly below and complementary to each raised peg on the top surface. The dominoes can be used for a three-dimensional game in which dominoes are placed next to each other on the same level or on top of each other where the sockets of the upper domino receive all of the pegs directly below it.

STATEMENT OF THE INVENTION

The present invention relates to a set of dominoes which can be used in a three-dimensional domino game.

Dominoes are playing tiles in the form of flat rectangular blocks, each playing tile being divided into two equal square halves or faces. The top surface of each face is blank or bears indicia; a face can usually be considered to represent a number corresponding to the number of indicia it bears.

Conventional domino games are played in two dimensions with a set of dominoes with from 0 to usually 6 or 9 indicia in the form of dots on each face. The indicia are usually arranged as on dice. Where the domino faces bear from 0 to 6 dots, the game is usually played with 28 dominoes representing all possible combinations of 2 faces bearing from 0 to 6 dots; this is commonly called the "double six" variation. Where the dominoes bear from 0 to 9 dots, the game is usually played with 55 dominoes similarly representing all possible combinations of the 2 faces, and commonly called the "double nine" variation. Players take turns placing one of their dominoes adjacent to and in the same plane as previously-played dominoes.

The present invention is a set of dominoes which can be used for three-dimensional play. Instead of bearing dots, however, the dominoes bear indicia in the form of raised pegs, all pegs being of the same size. Additionally, the under surfaces of the dominoes bear sockets, each domino face having the same number of sockets in its under surface as it has raised pegs on its upper surface. Each socket is located directly below a peg and is complementary to the pegs in the sense that each socket is sized to receive a peg. The set preferably contains $$\frac{(n+2)\times(n+1)}{2}$$

dominoes, where each face bears from 0 to n pegs. More preferably, the set contains one domino representing each possible combination of two numbers, where each face represents the number corresponding to the number of pegs it bears.

In the play of the three-dimensional game, players take turns placing one of their dominoes adjacent to or on top of previously played dominoes. A domino placed on top of another domino or dominoes must receive in its sockets all of the pegs below it. Scoring can be based on pairing the face or faces of the newly-played domino with the face or faces on previously played dominoes.

Embodiments of the present invention are particularly illustrated by the accompanying drawings, FIGS. 1 through 10.

Figures 1, 2:
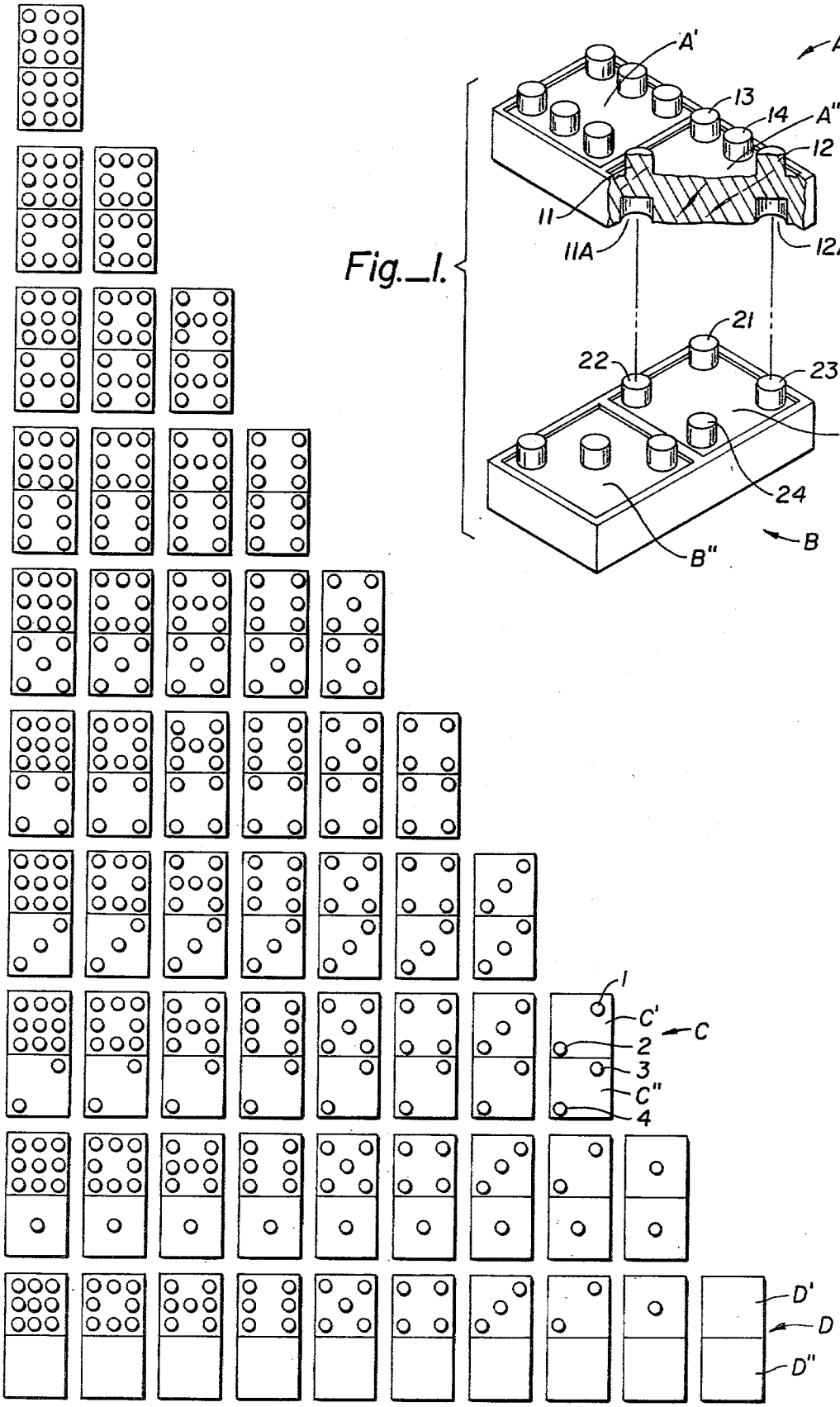
FIG. 1 is a side elevation of two dominoes of the present invention, the upper domino A being in partial cross-section. This diagram particularly illustrates the raised pegs on the upper surface of the dominoes and the sockets on the under surface.
FIGS. 2 and 3 are aerial views in reduced scale of the entire set of dominoes in two of the preferred embodiments.

Referring now to FIG. 1, the dominoes of the present invention have raised pegs as indicia on the top surface, and corresponding sockets in the under surface. In particular, raised pegs 11 and 12 of upper domino A on face A″ are shown in cross-section. Sockets 11A and 12A on the under surface of domino A and directly below pegs 11 and 12 are also shown in cross-section.

When face A″ of upper domino A is placed on top of face B′ of lower domino B in the position shown, pegs 22 and 23 on domino B are received in sockets 11A and 12A, respectively, of domino A. Additionally, peg 21 will be received in the socket (not shown) directly below peg 13 on domino A and peg 24 on domino B will be received in the socket (not shown) directly below the peg on the front corner of domino A which has been cut away.

In the preferred embodiments, the sets of dominoes for the present three-dimensional game have the same number of dominoes and the same arrangement of indicia on the faces as the "double six", or "double nine" sets of conventional dominoes. FIG. 2 illustrates the entire set of dominoes in the "double nine" embodiment of the present invention. The indicia on the faces of the dominoes are in the form of raised pegs and are illustrated as circles in FIG. 2. Each domino has a socket in its under surface directly below each raised peg as was illustrated in FIG. 1. Domino C, for example, bears two raised pegs 1 and 2 on face C′ and two raised pegs 3 and 4 on face C″, in the pattern shown, and has four sockets in its under surface, one directly below each of pegs 1, 2, 3, and 4. Domino D, for example, bears no raised pegs on either of its faces D′ or D″ and bears no sockets on the under surface.

Figure 3:
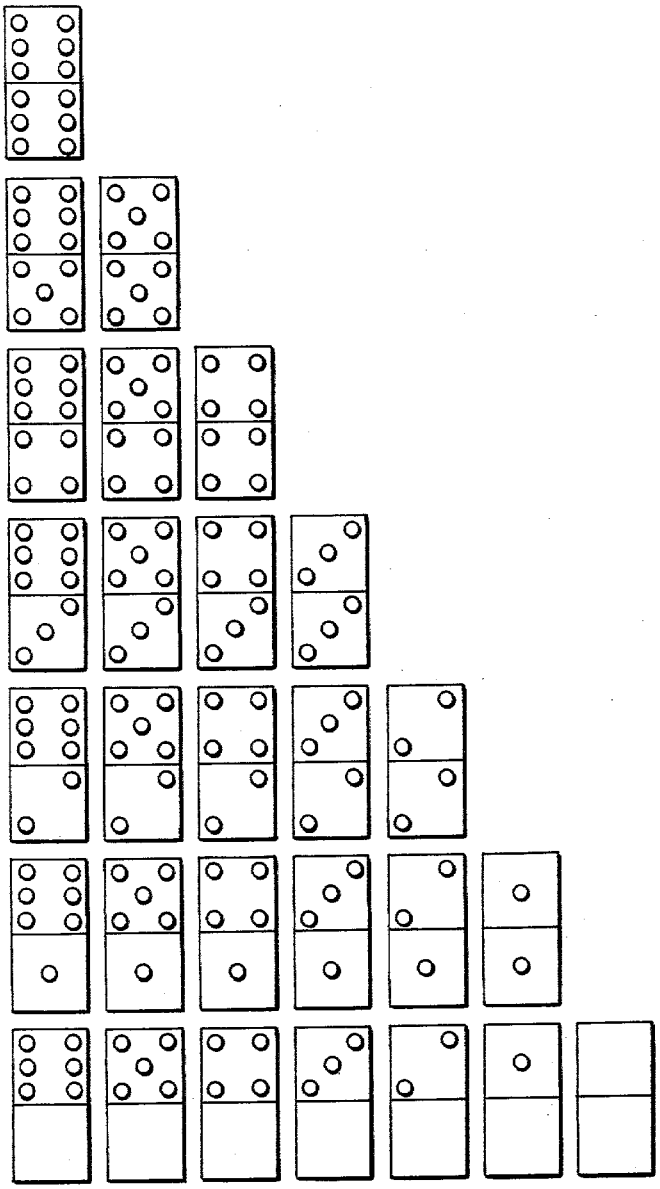

FIG. 3 similarly illustrates the entire set of "double six" three-dimensional dominoes. The indicia here are also in the form of raised pegs and the dominoes have corresponding sockets on the underside.

FIGS. 4 through 10 illustrate the use of the "double nine" three-dimensional dominoes in the play of a three-dimensional game.

In FIGS. 4 through 7, the dominoes E through H are aligned next to each other in the same plane; in FIGS. 8 and 9 the dominoes are on two levels; the dominoes I and J on the second level have a pattern of sockets on their underside such that each peg directly below dominoes I and J fits into a socket. FIG. 10 illustrates the dominoes on three levels, domino K on the third level having a pattern of sockets on its underside such that each peg directly below it is received in a socket.

The three-dimensional game played with the "double nine" preferred embodiment of the present invention can be played by two to four persons according to the following rules.

The dominoes are placed pegs down in a box or boxes and mixed. The boxes are placed above eye level or are covered so that the dominoes cannot be seen when chosen. To determine turns, each player picks a domino and shows it to the others. Naturally, when choosing dominoes, players cannot feel for pegs or holes. The player with the domino having the most pegs goes first and the play then proceeds in a clockwise direction from the first player.

When two or three play, each player chooses seven dominoes and places them on a rack out of sight of the other players. When four play, each player chooses five dominoes. Any flat, level area may be used as the playing surface. During his turn, each player plays one domino and then chooses another from the boxes to replace it. When all dominoes have been played, the player with the highest score wins the game.

The dominoes are played so that at least one face of a newly-played domino mates with (i.e. is adjacent to, on the same or on different levels), at least one face of a previously played domino. When a domino is played on a level above the first level the sockets in the newly-played domino must accept all of the pegs of the domino faces directly below. Also, both faces of the upper domino must be supported, i.e. one domino face cannot be cantilevered over empty space.

The total score for a given play is the sum of the scores attributable to each "domimate" made in the play. A domimate occurs when the total number of pegs on two mating faces is five, ten, or fifteen and can occur irrespective of the levels of the two faces. The score for each domimate is based on the face value of the domimate and on the level of each of the faces involved. A domimate having a peg total of five has a face value of one, a domimate having a peg total of ten has a face value of two, and a domimate having a peg total of fifteen has a face value of three. Mating faces which have peg totals other than five, ten, or fifteen have no face value, and cannot score. Two faces on a single domino cannot produce a domimate and cannot score either.

The score for each domimate is determined by multiplying its face value by its base level, and adding any bonus points. The base level is the level of the lower of the two faces, i.e., if the lower face is on level two of the game, the base level is 2. Bonus points are awarded if the two faces of the domimate are on different levels. The number of bonus points is equal to the difference between the two levels on which the faces are located. Thus, the score for each dominate is given by the formula:

(face value × base level) + bonus points = domimate score.

The total score in a given play is the sum of the scores attributable to each domimate.

Figure 4:
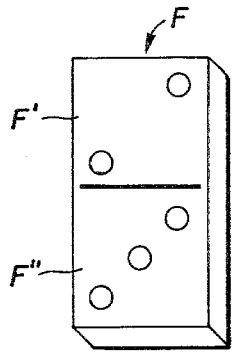
FIGS. 4 through 10 are aerial views at an angle of the dominoes as they can be played in a three-dimensional game.

FIGS. 4 through 10 can be used to illustrate the play of the three-dimensional game according to the above rules. FIG. 4 corresponds to play one. No domimates have occurred because the two faces of a single domino, here domino F, cannot be used to obtain points; the score is zero.

Figure 5:
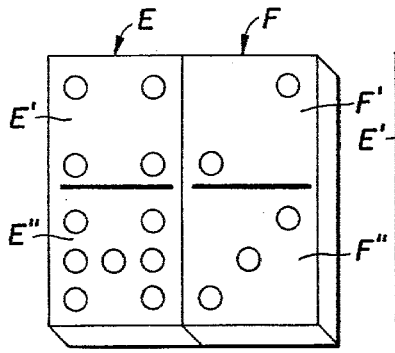

FIG. 5 represents the second play of a game in which domino E has been played. Faces E″ and F″ form a domimate having a peg total of 7 (from face E″) + 3 (from face F″), or 10, and a face value of 2. Since both faces are on level one, the first level, the base level is 1, the bonus points are 0, and the score is:

$$(2\times 1)+0=2.$$

Mating faces E′ and F′ do not have a peg total of 5, 10 or 15, therefore produce no domimate, and do not score. The total score for the play is 2.

Figure 6:
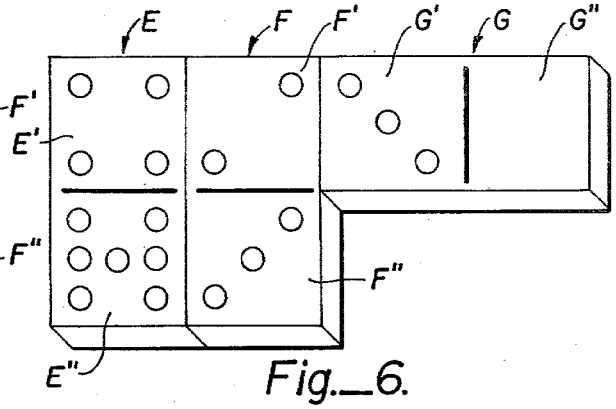

FIG. 6 corresponds to a third play in which domino G has been played. The only domimate is between faces F′ and G′ with a peg total of 2 + 3, or 5. The face value is 1, the base level is 1, there are no bonus points, and the total score is:

$$(1\times 1)+0=1.$$

Figure 7:
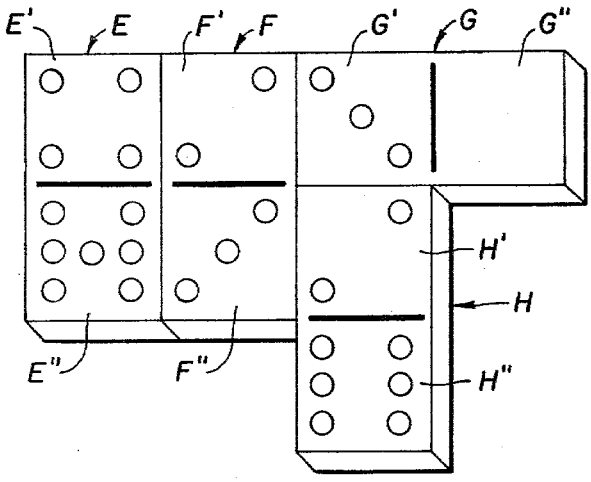

FIG. 7 represents a fourth play in which domino H is played. In this play, two domimates have been made. The peg total for adjacent faces H′ and F″ is 2 + 3, or 5, with a face value of 1. The base level is 1, there are no bonus points and the score for this domimate is:

$$(1\times 1)+0=1.$$

The peg total for adjacent faces H′ and G″ is also 5, producing a face value of 1. The base level is 1, there are no bonus points, and the following score results:

$$(1\times 1)+0=1.$$

The total score for the play is 1 (from the first domimate) + 1 (from the second domimate), or 2.

Figure 8:
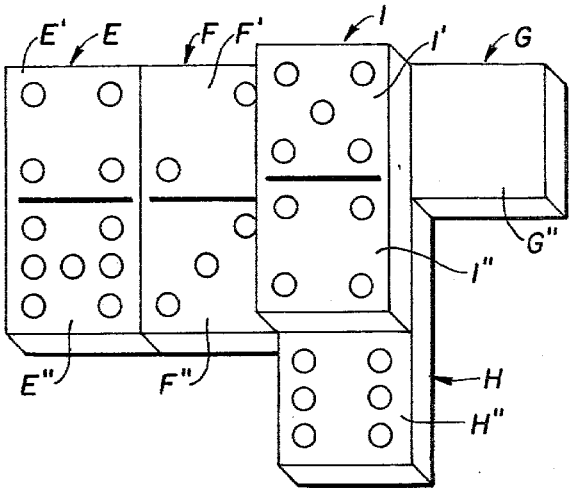

In FIG. 8, domino I has been played. This is the first play in which the newly-played domino is placed on a level above the previously played dominoes.

In this play are two domimates which provide a score. Face I′ and G″ have a total peg value of 5, giving a face value of 1. The base level is the level of the lower face, G″, or 1. In this case there is one bonus point, representing the difference between 2, the level of the higher face I′, and 1, the level of the lower face G″. Thus the score for the domimate between faces I′ and G″ is:

$$(1\times 1)+1=2.$$

Also in FIG. 8, faces I″ and H″ mate to produce a domimate and a score. The total number of pegs on the two faces is 10, giving a face value of 2. The base level is 1 and there is one bonus point because the higher level face, I″ on level two, is one level above the lower face, H″ on level one. Thus this domimate has a total score of:

$$(2\times 1)+1=3.$$

The total score for the entire play is 2 + 3 or 5.

Figure 9:
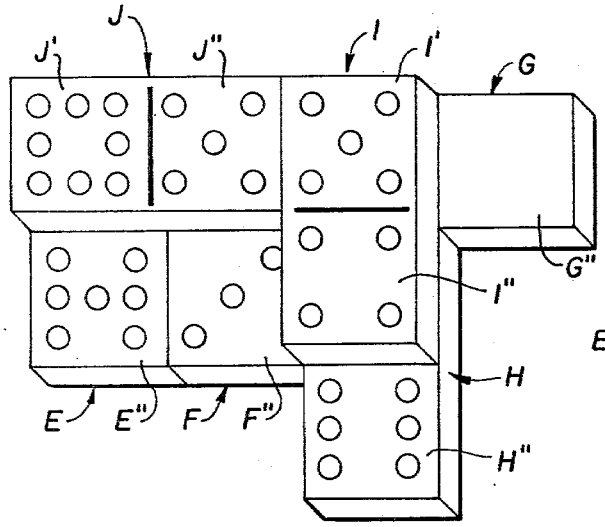
Figure 10:
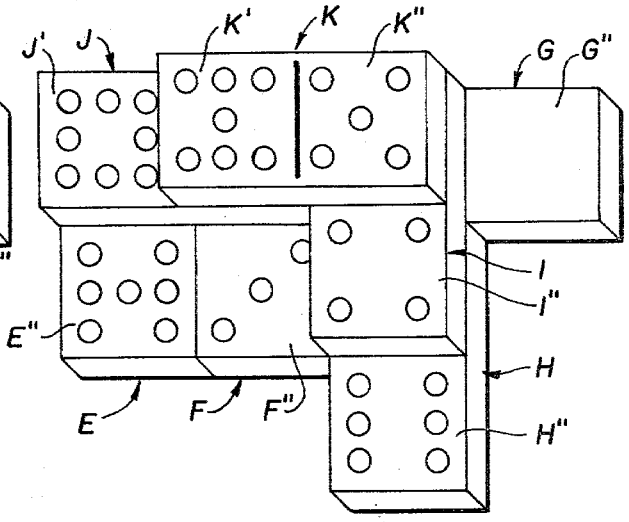

In FIG. 9, the newly-played domino, J, is also played on the second level. In this play, two domimates occur. Faces J′ and E″ have pegs totalling 15 which results in a face value of 3. The base level is 1 and there is one bonus point because face J′ is one level above face E″. The score for the domimate is:

$$(3\times 1)+1=4.$$

The other domimate is due to adjacent faces J″ and I′ which have a total peg value of 10 and a face value of 2. The base level here is 2 because the faces are both on level two. There are no bonus points because the two faces are on the same level; the score for the domimate is:

$$(2\times 2)+0=4.$$

The total score for the play is 4+4, or 8.

In FIG. 10, domino K is played on the third level. This play produces three domimates. Faces K′ and J′ have a total peg value of 15 producing a face value of 3. The base level is 2, the level of the lower face, J′, and there is one bonus point because the two faces are one level apart. This results in the following score for the domimate:

$$(3\times 2)+1=7.$$

Faces K″ and G″ produce a domimate having a total peg value of 5 and a face value of 1. The base level is 1, the level of face G″, and there are two bonus points because face K″ is two levels above face G″. The score for this domimate, then, is:

$$(1\times 1)+2=3.$$

Faces K′ and F″ also produce a score, having a total peg value of 10 and a face value of 2. The base level is 1, there are two bonus points because the two faces are two levels apart, and the score for the domimate is:

$$(2\times 1)+2=4.$$

The total score for the play is the sum of the scores for the domimate, 7+3+4, or 14.

Naturally, the above scoring and the rules of the play can be varied. Additionally, the structures described are not to be taken by way of limitation, and variations can be made within the scope of the invention.

What is claimed is:

1. In a domino-like game of skill, a set of 28 dominoes, each having two indicia segments and having:

(a) from 0 through 6 indicia in the form of raised pegs located in any of the same seven possible locations on the top surface of each segment, all raised pegs in the set being of the same size and shape, and, (b) the same number of sockets in the under surface of each segment as there are raised pegs on the top surface, all sockets being complementary to the raised pegs and one socket being directly below each raised peg; and, wherein the set includes one domino representing each possible combination of two numbers, each segment representing the number corresponding to the number of pegs it bears, whereby the segments of each of said dominoes will nest upon or under identical and certain non-identical segments of other of said dominoes, when the sockets of an upper domino receive the pegs of a lower domino.

2. In a domino-like game of skill, a set of 55 dominoes, each having two segements and having:

(a) from 0 through 9 indicia in the form of raised pegs located in any of the same nine possible locations on the top surface of each segment, all raised pegs in the set being of the same size and shape, (b) the same number of sockets in the under surface of each segment as there are raised pegs on the top surface, all sockets being complementary to the raised pegs and one socket being directly below each raised peg, and, wherein the set includes one domino representing each possible combination of two numbers, each face representing the number corresponding to the number of pegs it bears, whereby the segments of each of said dominoes will nest upon or under identical and certain non-identical segments of other of said dominoes, when the sockets of an upper domino receive the pegs of a lower domino.

3. The set of dominoes according to claim 2 depicted in FIG. 2.

4. The set of dominoes according to claim 1 depicted in FIG. 3.

* * * * *